US009140046B1

(12) United States Patent
Kuhl et al.

(10) Patent No.: US 9,140,046 B1
(45) Date of Patent: Sep. 22, 2015

(54) HANGER BRACKET USED IN OVERHEAD SLIDING DOOR INSTALLATION

(71) Applicants: Larry Kuhl, Cumberland, WI (US); Christopher J. Herman, White Bear Lake, MN (US)

(72) Inventors: Larry Kuhl, Cumberland, WI (US); Christopher J. Herman, White Bear Lake, MN (US)

(73) Assignee: Larry Kuhl, Cumberland, WI (US)

( * ) Notice: Subject to any disclaimer, the term of this patent is extended or adjusted under 35 U.S.C. 154(b) by 0 days.

(21) Appl. No.: 14/152,268

(22) Filed: Jan. 10, 2014

Related U.S. Application Data

(60) Provisional application No. 61/755,726, filed on Jan. 23, 2013.

(51) Int. Cl.
*A47H 1/10* (2006.01)
*E05D 15/16* (2006.01)

(52) U.S. Cl.
CPC ..... *E05D 15/16* (2013.01)

(58) Field of Classification Search
CPC .... E05F 15/668; E05F 15/1607; E05D 15/38; E05D 15/16
See application file for complete search history.

(56) References Cited

U.S. PATENT DOCUMENTS

| | | | | |
|---|---|---|---|---|
| 4,018,005 | A * | 4/1977 | Harris | 49/199 |
| 5,588,257 | A * | 12/1996 | Duhame et al. | 49/199 |
| 5,924,260 | A * | 7/1999 | Austin et al. | 52/698 |
| 6,511,028 | B1 * | 1/2003 | Gretz | 248/222.52 |

OTHER PUBLICATIONS

Description of/Directions for LiftMaster 195LM Ceiling Mount; copyright 2013, 2 pages.
Description of/Directions for Chamberlain Garage Door Installation Upgrade Kit, Model BIK01, 2 pages.
Website for Thunder Mount Garage Systems LLC Garage Door and Opener Mounting Kits, http://www.thundermounts.com/, last visited Nov. 20, 2013, 2 pages.
Website for Thunder Mount Garage Systems LLC Overhead Garage Door Opener Mounts, http://www.thundermounts.com/Thunder-Mount-System-Standard-TMS24671.htm, last visited Nov. 20, 2013, 1 page.
Website for Thunder Mount Garage Systems LLC Garage Door Tracks Kit, http://www.thundermounts.com/Thunder-Mount-Garage-Door-Tracks-Kit-TMHDGT246 . . . , last visited Nov. 20, 2013, 1 page.

* cited by examiner

*Primary Examiner* — Amy Sterling
(74) *Attorney, Agent, or Firm* — Andrus Intellectual Property Law, LLP

(57) ABSTRACT

A hanger bracket is used to support at least one of a guide track rail and an opener associated with the overhead sliding door installation for a building from a superstructure of the building. The hanger includes a first part having an upper wall configured to be attached to the superstructure of the building, and a pair of spaced apart side walls depending from the upper wall and defining an open bottom. A second part is adjustable relative to the first part, and has a support member joined to a support leg depending therefrom and configured to be attached to at least one of the guide track rail and the opener. The support member is slidably supported, received and retained on the first part. The side walls are formed with guiding and supporting structure configured to slidably engage the support member thereon.

20 Claims, 8 Drawing Sheets

HANGER BRACKET USED IN OVERHEAD SLIDING DOOR INSTALLATION

CROSS-REFERENCE TO RELATED APPLICATION

The present application relates to and claims priority based on U.S. Provisional Patent Application Ser. No. 61/755,726, filed Jan. 23, 2013.

FIELD OF THE INVENTION

The present disclosure relates generally to support and fixation devices and, more particularly, pertains to a hanger bracket for suspending a guide track rail and opener of an overhead sliding door from a superstructure of a building, such as a garage.

BACKGROUND OF THE INVENTION

Overhead sliding doors have been commonly used in garages, as well as loading docks, warehouses and other factory settings for many years. Conventional overhead sliding doors are of the sectional type, and typically include a number of rectangular door panels hinged together along upper and lower edges thereof. The door panels typically have roller devices that extend outwardly from each side of the door panels, and are slidably received and retained in adjacent curved guide track rails. The guide track rails are generally bent in a gradual curve from a vertical section mounted at the front of the garage to a horizontal section which extends beneath and is supported by hanger brackets at a rear end thereof from the ceiling or superstructure of the garage. The guide track rails guide the sliding door between open and closed positions. Overhead sliding doors are also known to employ a powered opener which is further supported by hanger brackets from the garage ceiling or superstructure in the middle of the guide track rails, and provided with an arrangement connected to the sliding door for automatically opening and closing the door using a manual switch or remote actuator.

Prior art hanger brackets used in supporting guide track rails in overhead sliding door installations are commonly formed of an angled, perforated metal assembly comprised of three pieces. A first horizontally extending piece is fixed by fasteners to the garage superstructure. A second vertically extending piece is connected by fasteners to the first piece, and depends downwardly therefrom for connection to the end of the guide track rail. A third piece is joined by fasteners to the first and second pieces, and acts as a brace disposed at an angle to the first and second pieces. Prior art hanger brackets used in supporting door openers rely on a different three piece angled, perforated metal assembly wherein a first horizontal extending piece is anchored to the garage superstructure, and second and third vertically extending pieces are connected by fasteners between the first piece and opposite sides of the opener. Such universally known hanger brackets have been found to be time consuming to install, and do not always offer the necessary support desired for long time sliding overhead door use.

Accordingly, there remains a need for improvement in a sliding overhead door hanger bracket which will make installation of the door less costly and labor intensive, and also provide a reliable structural support which will maintain the alignment of the guide track rails and opener over time.

SUMMARY OF THE INVENTION

The present disclosure relates to a hanger bracket which is used to support at least one of a guide track rail and an opener associated with an overhead sliding door installation for a building from a superstructure of the building. The hanger bracket includes a first part having an upper wall configured to be attached to the superstructure of the building, and a pair of spaced apart side walls depending from the upper wall and defining an open bottom extending along the entire length of the first part. A second part is adjustable relative to the first part and has a support member joined to a support leg depending therefrom, and configured to be attached to at least one of the guide track and the opener. The support member is slidably supported, received and retained on the first part. The spaced apart side walls are formed with guiding and supporting structure configured to slidably engage the support member thereon.

The support member is slidably adjusted to a desired position on the first part, and retained axially thereon by a third part engaged against the upper wall. The spaced apart side walls of the first part have bottom ends formed with inwardly extending curled retaining portions. The upper wall of the first part is formed with at least one hole to enable securement to the superstructure. The at least one hole is accessible from a bottom end of the first part. The support member has an upper end which is slidably received and retained between the sidewalls of the first part. The support member is supported upon the retaining portions of the first part.

In one exemplary embodiment, the support member has a bar formed with a set of threaded apertures therein. The bar is clamped against the upper wall of the first part by a group of set screws retained in the threaded apertures.

In another exemplary embodiment, the support member includes a pair of spaced apart support plates having upper ends bent over to form U-shaped channels. The support plates have inner surfaces and outer surfaces joined by upper surfaces. The inner surfaces are formed with aligned V-shaped cutouts. The outer surfaces are formed with aligned U-shaped grooves that are in registration with the V-shaped cutouts. Portions of the upper surfaces are removed in the vicinity of the cutouts and the grooves. The support plates are retained in the first part by a camming lever. The camming lever includes an elongated handle and a camming arrangement formed on the handle. The camming arrangement includes a pair of spaced apart camming ears, and a pivot pin structure pivotally mounted relative to the support plates. The handle is movable between an unlocked position and a locked position such that the camming surfaces are selectively disengaged and engaged with the upper wall of the first part.

The present disclosure further contemplates a method of supporting at least one of a guide track rail and an opener associated with an overhead sliding door installation of a building from a superstructure of the building. The method includes the steps of a) providing a hanger bracket having a first part provided with an upper wall, and a pair of spaced apart side walls depending from the upper wall and defining an open bottom extending along an entire length of the first part, the side walls being formed with guiding and supporting structure thereon, the hanger bracket also having a second part which is adjustable relative to the first part, the second part having a support member joined to a support leg depending therefrom, the first part being configured to movably support the second part therefrom; b) attaching the first part to the superstructure of the building; c) moving the second part relative to the first part along the guiding and supporting structure such that the second part is supported by the first part at a desired position thereon; d) locking the second part relative to the upper wall of the first part at the desired position so that the support leg extends through and beneath the first part; and e) fastening the support leg to at least one of the guide track rail and the opener.

The present disclosure further contemplates a hanger bracket used to support a device from a support structure. The hanger bracket includes a first part having an upper wall configured to be attached to the support structure, and a pair of spaced apart side walls depending from the upper wall and defining an open bottom extending along an entire length of the first part. A second part is adjustable relative to the first part and has a support member joined to a support leg depending therefrom and configured to be attached to the device. The support member is slidably supported, received and retained on the first part. The spaced apart side walls of the first part are formed with guiding and supporting structure configured to slidably engage the support member thereon.

BRIEF DESCRIPTION OF THE DRAWINGS

The best mode of carrying out the disclosure described herein below with reference to the following figures.

DETAILED DESCRIPTION

Prior Art

In an overhead sliding door installation for a building, such as a garage, hanger brackets are commonly utilized as support and fixation devices. As is well known, a sliding door is comprised of a number of panels hinged together and provided on opposite sides thereof with rollers that are received and retained in a pair of curved, channel-like guide track rails, each of which is supported by a hanger bracket. It is also well known that the sliding door can be commonly moved along the path of the guide track rails (i.e. raised and lowered) by a powered opener which is located between the guide track rails, and is separately supported by another hanger bracket arrangement.

Figure 1:
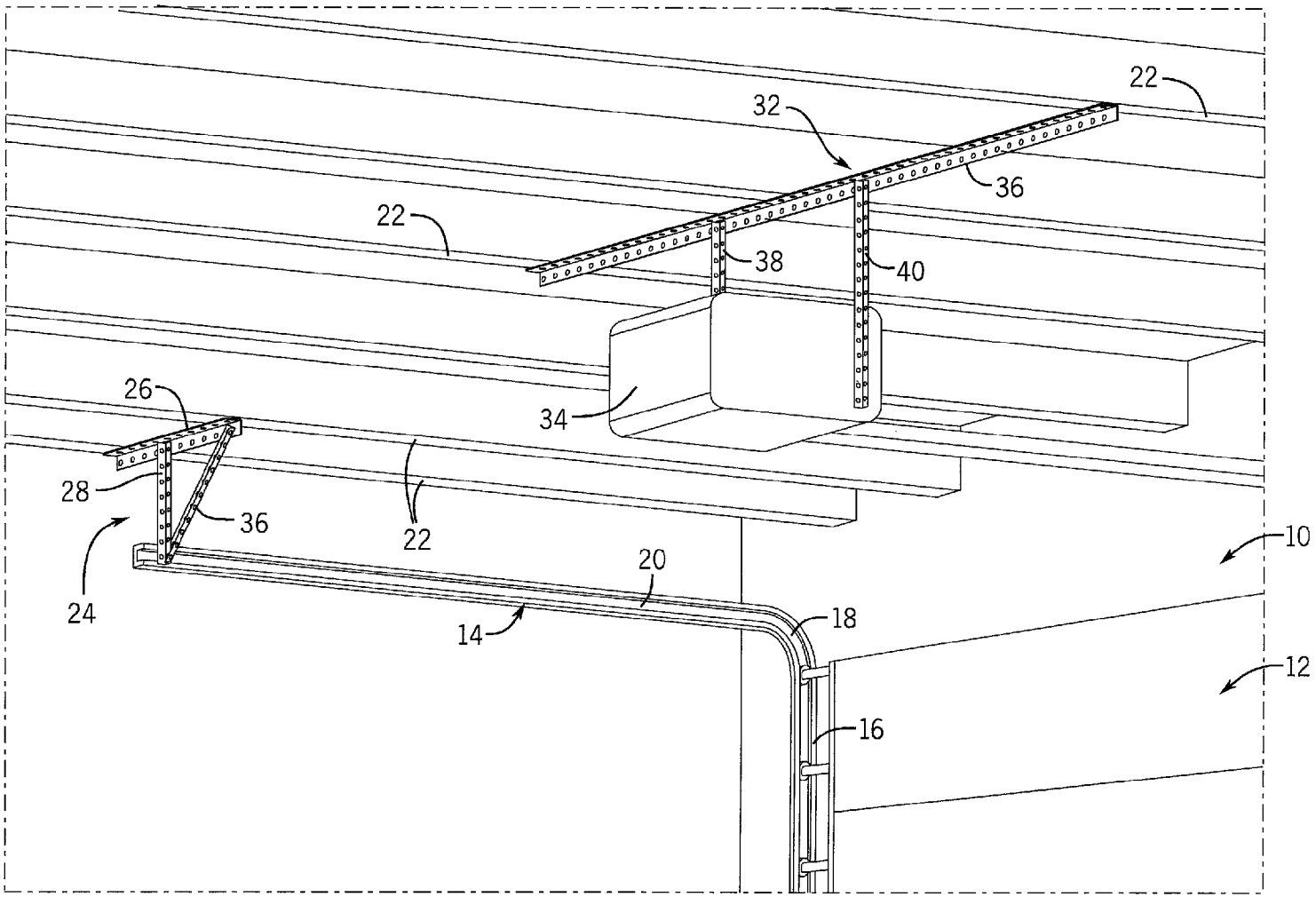
FIG. 1 PRIOR ART
FIG. 1 is a partial perspective view of an overhead sliding door installation employing a prior art door hanger bracket.

Referring now to the drawings, FIG. 1 illustrates a partial perspective view of a typical sliding door installation for a garage or other building 10, which shows one side of a sliding door 12 that is designed to be moved along a curved guide track rail 14. The guide track rail 14 has a vertical portion 16 mounted to a front of the building 10 adjacent a door opening, a curved portion 18, and a horizontal section 20 which is supported at a rearward end beneath a superstructure or beams 22 of the building 10 by a prior art hanger bracket 24. It should be understood that the other side of the sliding door 12 not illustrated in FIG. 1 is also provided with a similar guide track rail 14 and hanger bracket 24.

The prior art hanger bracket 24 is generally comprised of a three piece, angled perforated metallic assembly. A first horizontally extending piece 26 is attached by fasteners to a pair of beams 22. A second vertically extending piece 28 has a top end fixed by fasteners to one end of the first piece 26. A third piece 30 is fixedly connected by fasteners at an angle to a bottom end of the second piece 28 and to a portion of the first piece 26 between the opposite ends thereof. The bottom of the prior art hanger bracket 24 is joined by fasteners to the rear end of the guide track rail 14.

FIG. 1 also illustrates a prior art hanger bracket 32 for a door opener 34. The prior art hanger bracket 32 is a different three piece, angled perforated metallic assembly. A first horizontally extending piece 36 is attached by fasteners across several beams 22. Second and third vertically extending pieces 38, 40 are fixedly coupled by fasteners at upper ends to the first piece 36 and at lower ends to the top or sides of the opener 34.

THE PRESENT DISCLOSURE

Figure 2:
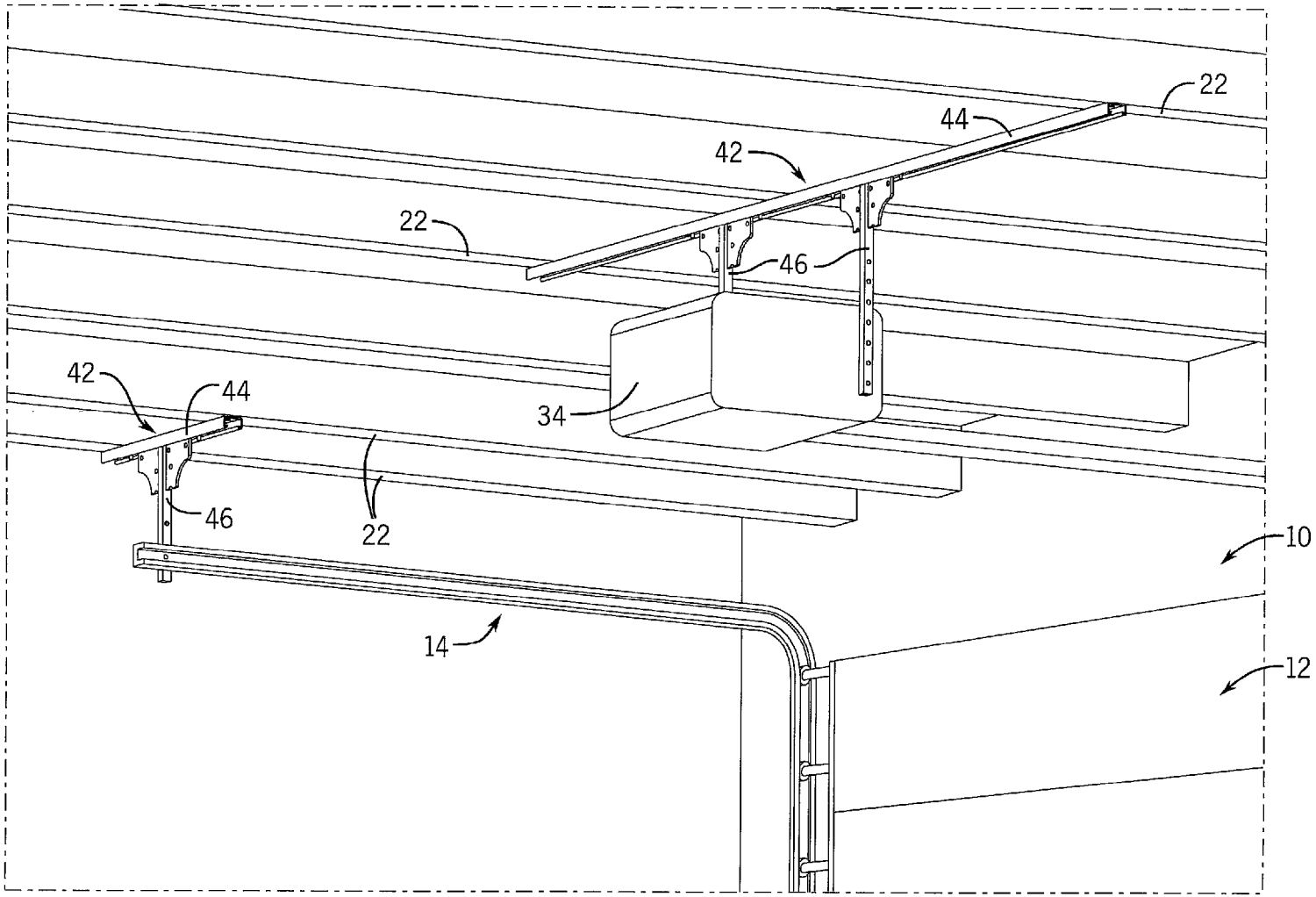
FIG. 2 is view similar to FIG. 1 showing a door hanger bracket in accordance with the present disclosure.
Figure 3:
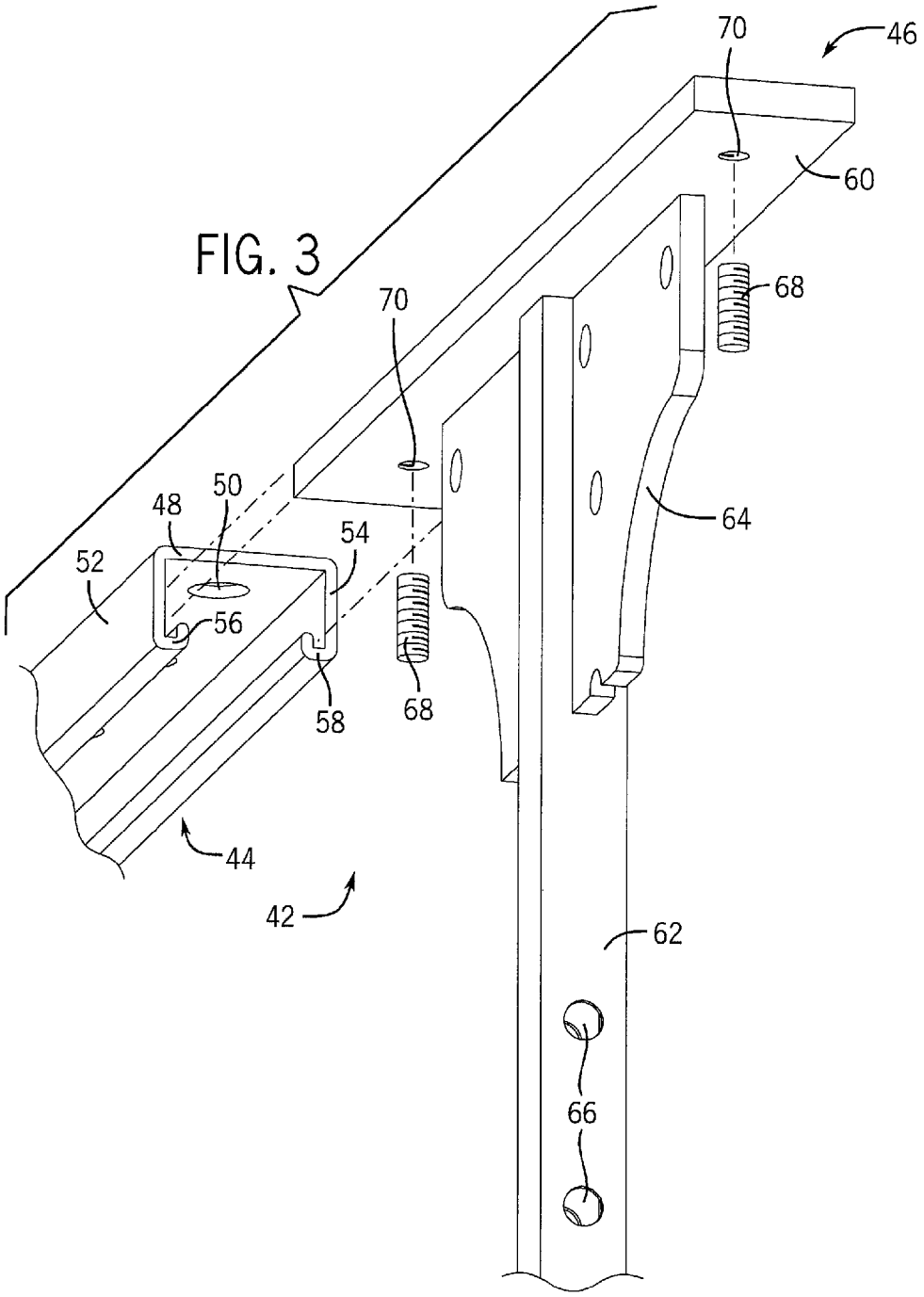
FIG. 3 is an exploded view of the door hanger bracket shown in FIG. 2.
Figure 4:
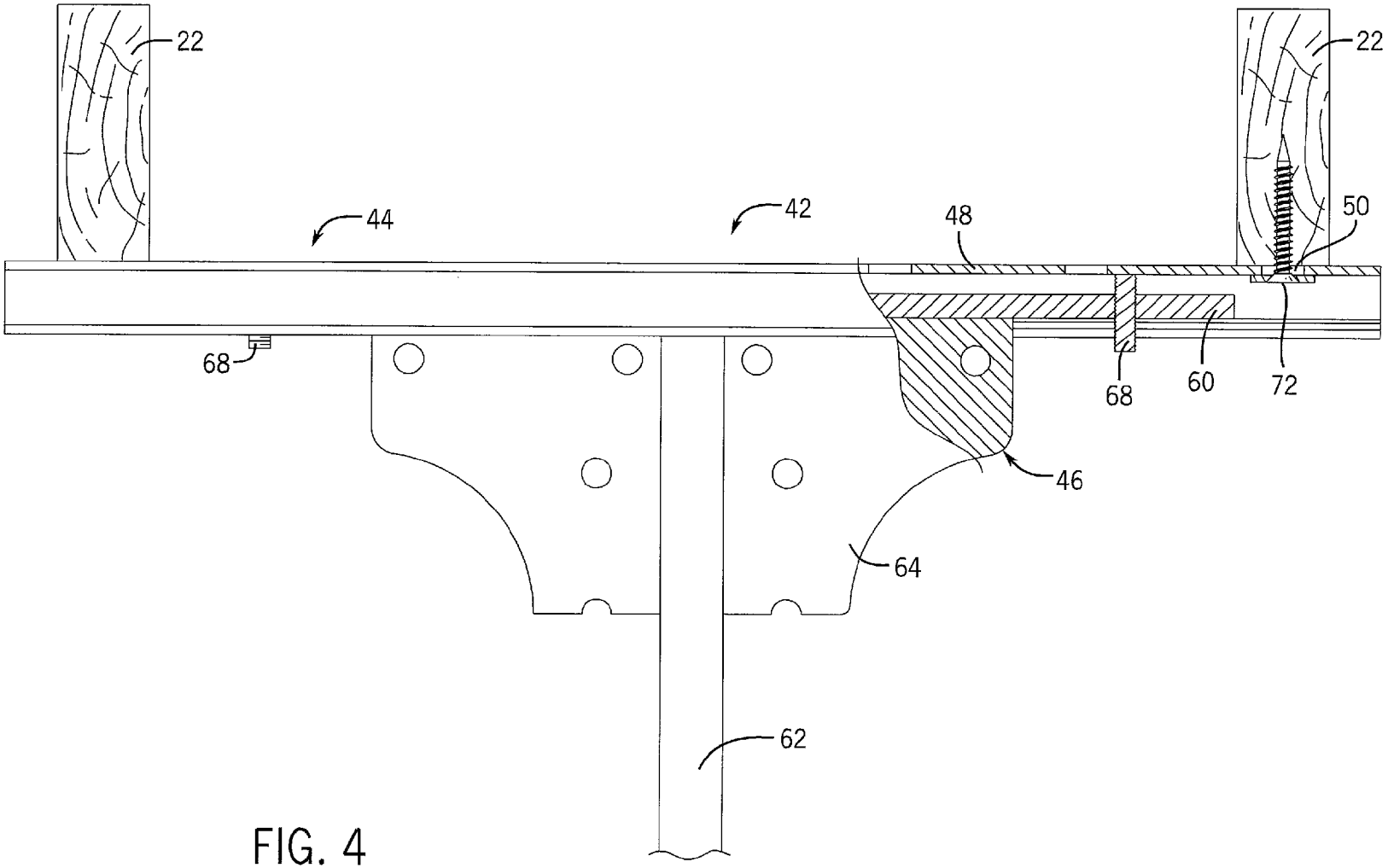
FIG. 4 is an enlarged assembled view in partial cross section of the door hanger bracket shown in FIG. 2.
Figure 5:
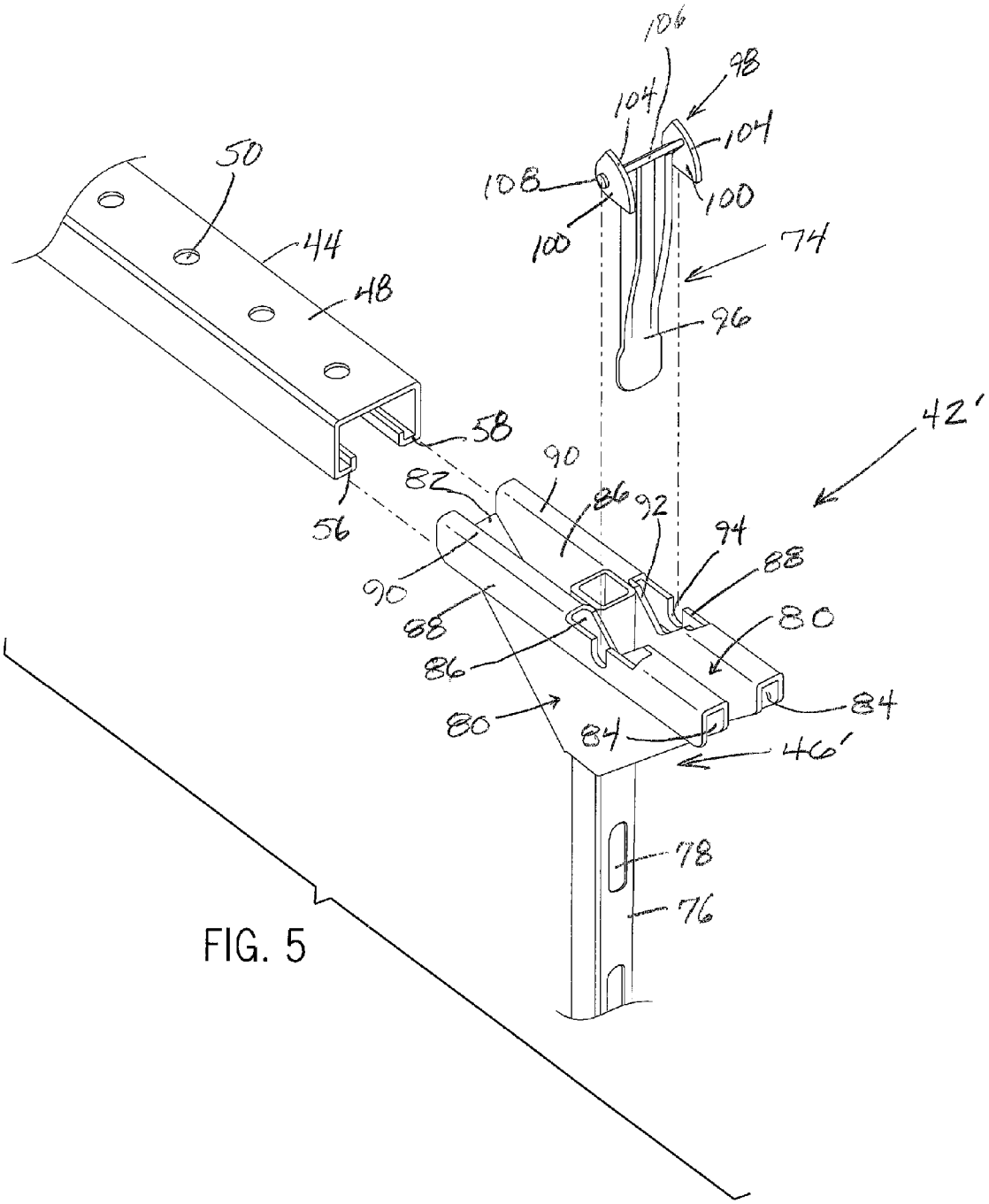
FIG. 5 is an exploded view of an alternative embodiment of door hanger bracket.

FIG. 2 illustrates a sliding door installation similar to FIG. 1 in which the prior art hanger brackets 24 and 32 are replaced by hanger brackets 42 in accordance with the present disclosure. As more clearly seen in FIGS. 3 and 4, the hanger bracket 42 is a multi-piece assembly such as formed of metal or other rigid materials. The hanger bracket 42 has a first horizontally extending part 44 designed as a first mounting bracket to be anchored to the building or garage superstructure, ceiling or beams 22, and a second generally T-shaped part 46 designed as a second mounting bracket which is slidably supported on, received and retained in the first part 44, and depends therefrom for connection to the guide track rail 14 and the opener 34.

The first part 44 has a flat upper wall 48 having a number of spaced apart holes 50 formed therethrough and along a length thereof to enable securement to the superstructure 22. A pair of spaced apart side walls 52, 54 depends from the upper wall 48 and is formed at bottom ends with inwardly extending curled retaining portions 56, 58 so that the upper wall 48 and the side walls 52, 54 form a retaining channel. The first part 44 has an open bottom 59 which extends continuously along an entire length of the first pan 44 between portions 56, 58. The side walls 52, 54 and the retaining portions 56, 58 are solid throughout their length.

The second part 46 has a horizontally extending, flat bar 60 that is integrally and rigidly connected to a vertically depending support leg 62 and forms the top end of a support member such as a gusset 64 or the like joined between the bar 60 and the leg 62 to provide rigidity. The support gusset 64 may be formed of any shape and size, and may have an ornamental or decorative construction which enhances the overall aesthetics of the support bracket 42. The support gusset 64 is shown in the exemplary embodiments with holes and notches, but may be otherwise ornately designed as desired. The support leg 62 is formed with a series of throughholes 66 along its length to facilitate attachment to the guide track rail 14. The bar 60 of the second part 46 is slidably received and retained in the channel formed by the first part 44, and is fixed ably thereto using a third part in the form of set screws 68, which are turned through threaded apertures 70 formed in the bar 60 and clamped against solid portions of the upper wall 48 of the first part 44. The apertures 70 are accessed through an open bottom of the channeled first part 44. The support leg 62 is attached to the rear end of the guide track rail 14 or the sides of the opener 34 by passing suitable fasteners through aligned holes formed in the support leg 62 and the guide track rails 14, and the aligned holes formed in the support leg 62 and the sides of the opener 34. It should be appreciated that the first and second parts 44, 46 may have various sizes and shapes as desired depending on the particular installation. It should be further appreciated that the support leg 62 is rigidly attached at the desired position on the first part 44.

In use, fasteners such as shown at 72 (FIG. 4) are passed through the holes 50 of the first part 44 and turned appropriately to fix the first part 44 to the beams 22 at a desired location. The first part 44 is fixed so that a longitudinal axis thereof is substantially perpendicular to the longitudinal axes of the beams 22. Then, the horizontal bar 60 of the second part 46 is slidably inserted into the channel of the first part 44 so that the bar 60 is slidably supported on the retaining portions 58, 60, and is positioned longitudinally therein as desired so that the bottom end of the support leg 62 is aligned with the rear end of the guide track rail 14 or the opener 34. It should be appreciated that the bar 60 is slidably supported and retainable in the channel formed by the first part 44 by means of the inwardly extending portions 56, 58 which define guiding and supporting structure. However, the present disclosure contemplates other guiding and supporting structure for permitting sliding movement yet retaining bar 60 within first part 44, such as by forming grooved portions on the inside surfaces of the side walls 52, 54 for receiving edges of the bar 60. Thereafter, the second part 46 is anchored to the first part 44 axially thereof using set screws 68, and fasteners are used to couple the bottom end of support leg 62 with at least one and preferably both of the guide track rails 14 and opener 34. Once the second part 46 is anchored to the first part 44, the support leg 62 extends downwardly through and below the first part 44. In certain installations, the sliding door 12 is constructed only for manual raising and lowering thereof in which case no opener 34 is provided. In this type of situation, the support bracket 42 of the present disclosure is used to support only the guide track rails 14.

In some instances, it may be desirable to use only the second part 46 as a support bracket 42. In such case, the bar 60 is fixed directly to the beams 22, and the support leg 62 is fastened to the guide track rail 14 and/or the opener 34.

The present disclosure also contemplates an alternative embodiment of hanger bracket identified by reference numeral 42' in FIGS. 5-8. Hanger bracket 42' includes the first horizontally extending part 44, as discussed above, and a generally T-shaped second part 46' which is slidably supported on, received and retained in the first part 44, and depends therefrom for connection to the guide track rail 14 and the opener 34. The hanger bracket 42' also includes a third part in the form of a camming lever 74 which is pivotally mounted to the second part 46'. As will be better understood below, the camming lever 74 is used to selectively lock and unlock the second part 46' relative to the first part 44.

The second part 46' has a vertically depending support leg 76 having an upper portion fixed, such as by welding, to and between inner surfaces of a pair of spaced apart support plates 80 defining a support member or gusset. The support leg 76 is formed with a series of through slots 78 along its length to facilitate attachment to the guide track rail 14 and/or the opener 34. The support plates 80 are connected together on one side thereof by a sidewall 82, and are accessible from an opposite side in which the support plates 80 are unconnected. Upper ends of the support plates 80 are bent over outwardly and downwardly to form a pair of inverted U-shaped channels 84. Each channel 84 includes an inner surface 86 and an outer surface 88 joined by an upper surface 90. The inner surfaces 86 are formed with aligned V-shaped cutouts 92 which are in registration with aligned U-shaped grooves 94 configured in the outer surfaces 88. Portions of the upper surfaces 90 are also removed in the vicinity of the cutouts 92 and the grooves 94.

The camming lever 74 is constructed with an elongated handle 96 and a camming arrangement 98 integrally formed at the top of the handle 96. The camming arrangement 98 includes a pair of spaced apart camming ears 100 connected by an inclined top wall 102 of the handle 96. The camming ears 100 are formed with eccentrically shaped, curved camming surfaces 104. The camming lever 74 also includes a pivot pin structure 106 having outer ends 108 which extend laterally and outwardly from the camming ears 100. The camming lever 74 is pivotally mounted relative to the second part 46' such that the handle 96 is movable between respective internal surfaces of the support plates 80 with the pivot pin structure 106 positioned in the V-shaped cutouts 92, the outer ends 108 received and retained in the U-shaped grooves 94 and the ears 100 disposed for swinging movement between the inner surfaces 86 and the outer surfaces 88 in the areas removed from the upper surfaces 90. The handle 96 is configured for manual movement between an unlocked position (FIG. 6) and a locked position (FIG. 7) such that the camming surfaces 104 are disengageable and frictionally engageable with the upper wall 48 of the first part 44.

Figure 6:
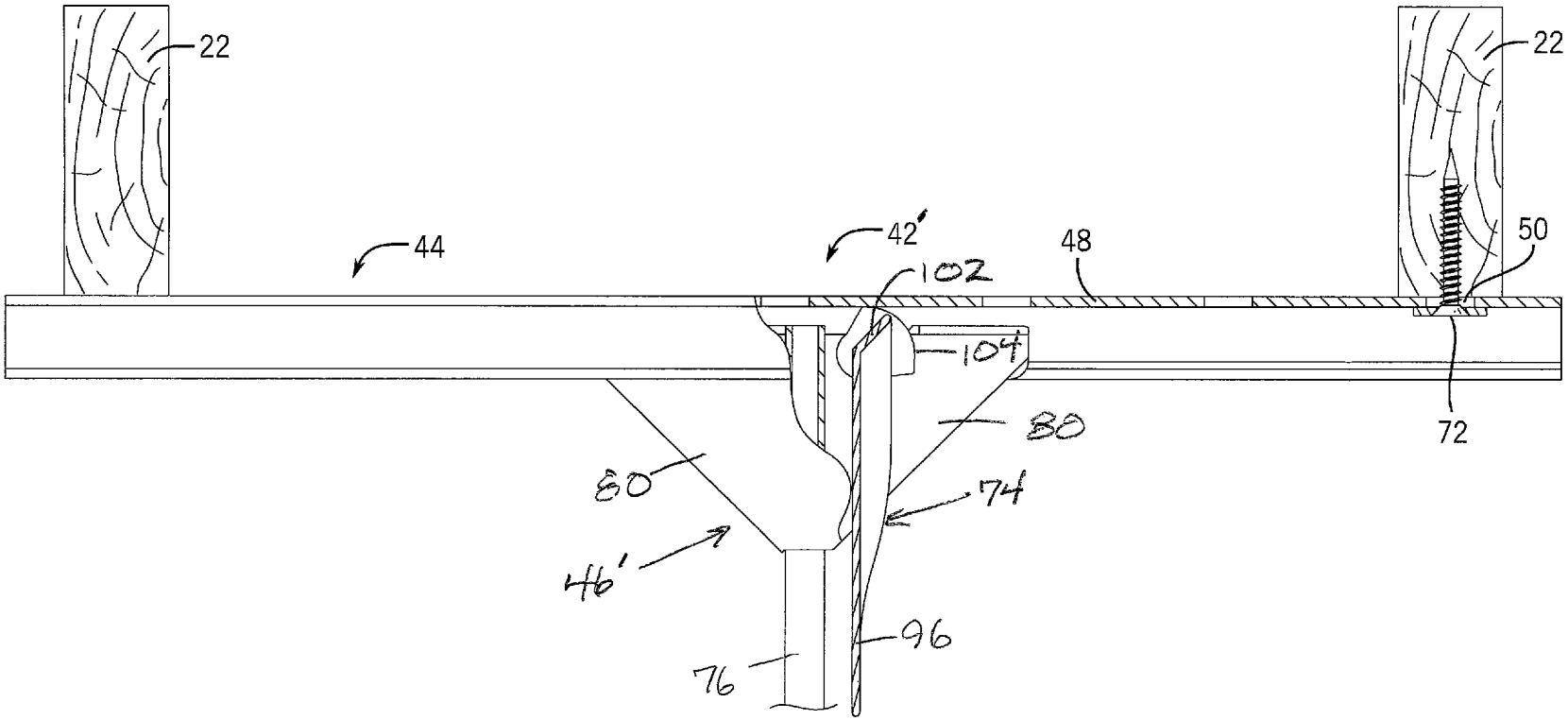
FIG. 6 is an assembled view in partial cross section of the door hanger bracket shown in FIG. 5 in an unlocked position.
Figure 7:
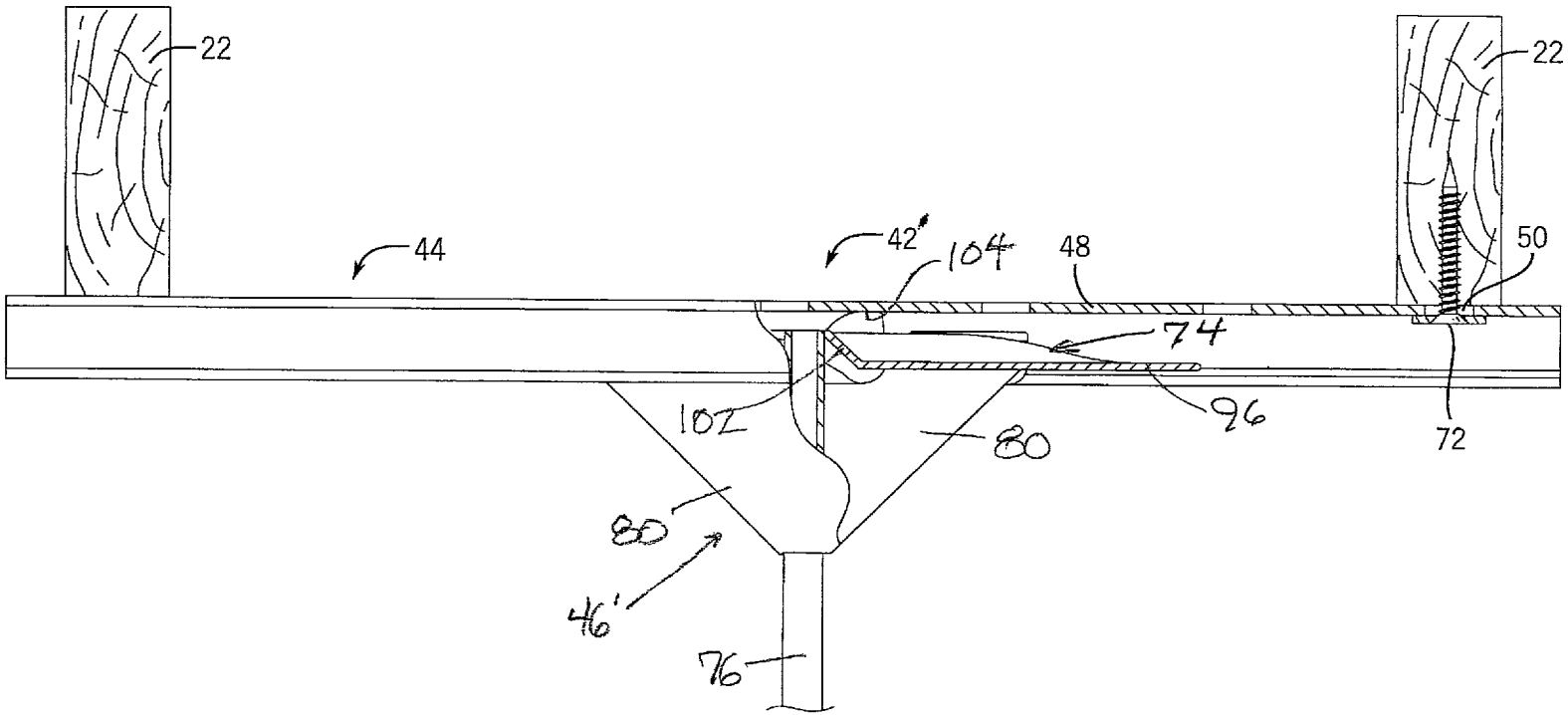
FIG. 7 is a view similar to FIG. 6 showing the door hanger bracket in a locked position.
Figure 8:
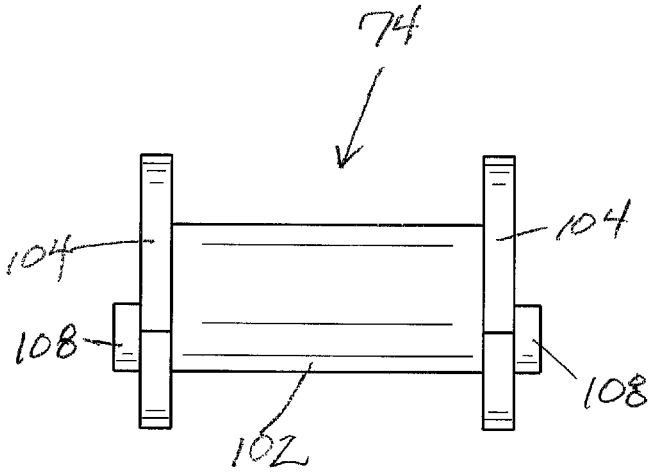
FIG. 8 is a top view of a camming lever used in the door hanger bracket shown in FIGS. 5-7.

In use, the first part 44 is fixed to the beams 22 by fasteners 72 (FIG. 6) at a desired location as described above relative to the hanger bracket 42. Then, the upper ends of the support plates 80 of the second part 46' are slidably inserted into the first part 44 such that the support plates 80 are positioned between the inner surfaces of the retaining portions 56, 58 and bottom edges of the outer surfaces 88 slide along bottom surfaces of the retaining portions 56, 58 which define guiding and supporting structure. The camming lever 74 is downwardly disposed in the unlocked position of FIG. 6 so that the camming surfaces 104 freely slide relative to the upper wall 48. The second part 46' is thus slidably supported and retained within the channel of the first part 44, and is positioned longitudinally as desired at a chosen location so that the bottom of support leg 76 is aligned with the rear end of guide track rail 14 or the opener 34. Thereafter, the second part 46' is rigidly locked to and held in the first part 44 axially thereof by pivoting the camming lever 74 to the locked position shown in FIG. 7 so that an end of the wall 102 contacts the top end of support leg 76 and the camming surfaces 104 frictionally engage the underside of upper wall 48. As seen in FIG. 6, support leg 76 extends through and below the first part 44. Fasteners are used to couple the bottom end of support leg 76 with at least one and preferably both of the guide track rails 14 and the opener 34.

While the foregoing paragraphs describe the hanger bracket 42, 42' for preferred use in garage door installations, it should be understood that the present disclosure also contemplates further uses. Other applications of the hanger bracket 42, 42' include, but are not limited to, quick adjust shelving, a boat trailer winch mount, ceiling mounted storage shelf supports, a garage or bike mount organizer, an adjustable office desk or table, scaffolding, and a deer/tree stand. If desired, the hanger bracket 42, 42' can be provided with rubber to avoid vibration and noise. The disclosure envisions other applications in which the hanger bracket 42, 42' may be useful beyond those examples set forth above.

Various alternatives are contemplated as being within the scope of the following claims particularly pointing out and distinctly claiming the subject matter regarded as the invention.

What is claimed is:

1. A hanger bracket used to support at least one of a guide track rail and an opener associated with an overhead sliding door installation for a building from a superstructure of the building, the hanger bracket comprising:

a first part having an upper wall configured to be attached to the superstructure of the building, and a pair of spaced apart side walls depending from the upper wall and defining an open bottom extending along an entire length of the first part; and a second part which is adjustable relative to the first part, the second part having a support member joined to a support leg depending therefrom and configured to be attached to at least one of the guide track rail and the opener, the support member being slidably supported, received and retained on the first part, wherein the spaced apart side walls of the first part are formed with guiding and supporting structure configured to slidably engage the support member thereon; and wherein the support member is slidably adjusted to a desired position on the first part, and retained axially thereon by a third part, the third part being movable between an unlocked position and a locked position such that the third part is selectively disengaged and engaged with the upper wall of the first part.

2. The hanger bracket of claim 1, wherein the spaced apart side walls of the first pan have bottom ends formed with inwardly extending curled retaining portions.

3. The hanger bracket of claim 1, wherein the upper wall of the first part is formed with at least one hole to enable securement to the superstructure.

4. The hanger bracket of claim 3, wherein the at least one hole is accessible from a bottom end of the first part.

5. The hanger bracket of claim 1, wherein the support member has an upper end which is slidably received and retained between the side walls of the first part.

6. The hanger bracket of claim 1, wherein the support member has a bar formed with a set of threaded apertures therein.

7. The hanger bracket of claim 6, wherein the bar is clamped against the upper wall of the first part by a group of set screws retained in the threaded apertures.

8. The hanger bracket of claim 2, wherein the support member is supported upon the retaining portions of the first part.

9. The hanger bracket of claim 1, wherein the support member includes a pair of spaced apart support plates having upper ends bent over to form U-shaped channels.

10. The hanger bracket of claim 9, wherein the support plates have inner surfaces and outer surfaces joined by upper surfaces.

11. The hanger bracket of claim 10, wherein the inner surfaces are formed with aligned V-shaped cutouts.

12. The hanger bracket of claim 11, wherein the outer surfaces are formed with aligned U-shaped grooves that are in registration with the V-shaped cutouts.

13. The hanger bracket of claim 12, wherein portions of the upper surfaces are removed in the vicinity of the cutouts and the grooves.

14. The hanger bracket of claim 9, wherein the support plates are retained in the first part by a camming lever.

15. The hanger bracket of claim 14, wherein the camming lever includes an elongated handle and a camming arrangement formed on the handle.

16. The hanger bracket of claim 15, wherein the camming arrangement includes a pair of spaced apart camming ears formed with camming surfaces, and a pivot pin structure pivotally mounted relative to the support plates.

17. The hanger bracket of claim 16, wherein the handle is movable between an unlocked position and a locked position such that the camming surfaces are selectively disengaged and engaged with the upper wall of the first part.

18. A hanger bracket used to support a device from a support structure, the hanger bracket comprising:

a first part having an upper wall configured to be attached to the support structure, and a pair of spaced apart side walls depending from the upper wall and defining an open bottom extending along an entire length of the first part; and a second part which is adjustable relative to the first part, the second part having a support member joined to a support leg depending therefrom and configured to be attached to the device, the support member slidably supported, received and retained on the first part, wherein the spaced apart side walls of the first part are formed with guiding and supporting structure configured to slidably engage the support member thereon; and wherein the support member is slidably adjusted to a desired position on the first part and retained axially thereon, there being a locking member between the first part and the second part which is movable between an unlocked position and a locked position such that the locking member is selectively disengaged and engaged with the upper wall of the first part.

19. A hanger bracket used to support at least one of a guide track rail and an opener associated with an overhead sliding door installation for a building from a superstructure of the building, the hanger bracket comprising:

a first part having an upper wall configured to be attached to the superstructure of the building, and a pair of spaced apart side walls depending from the upper wall and defining an open bottom extending along an entire length of the first part; and a second part which is adjustable relative to the first part, the second part having a support member joined to a support leg depending therefrom and configured to be attached to at least one of the guide track rail and the opener, the support member being slidably supported, received and retained on the first part, wherein the spaced apart side walls of the first part are formed with guiding and supporting structure configured to slidably engage the support member thereon, wherein the support member includes a pair of spaced apart support plates having upper ends bent over to form U-shaped channels, and wherein the support plates are retained in the first part by a camming lever.

20. A hanger bracket used to support at least one of a guide track rail and an opener associated with an overhead sliding door installation for a building from a superstructure of the building, the hanger bracket comprising:

a first pan having an upper wall configured to be attached to the superstructure of the building, and a pair of spaced apart side walls depending from the upper wall and defining an open bottom extending along an entire length of the first part; and a second part which is adjustable relative to the first part, the second part having a support member joined to a support leg depending therefrom and configured to be attached to at least one of the guide track rail and the opener, the support member being slidably supported, received and retained on the first part, wherein the spaced apart side walls of the first part are formed with guiding and supporting structure configured to slidably engage the support member thereon, wherein the support member includes a pair of spaced apart support plates having upper ends bent over to form U-shaped channels, and wherein the support plates are retained in the first pan by a camming lever, wherein the camming lever includes an elongated handle and a camming arrangement formed on the handle, wherein the camming arrangement includes a pair of spaced apart camming ears formed with camming surfaces, and a pivot pin structure pivotally mounted relative to the support plates, and wherein the handle is movable between an unlocked position and a locked position such that the camming surfaces are selectively disengaged and engaged with the upper wall of the first part.

* * * * *